US009254494B2

(12) United States Patent
Lin et al.

(10) Patent No.: US 9,254,494 B2
(45) Date of Patent: Feb. 9, 2016

(54) SHOWER WITH VARIOUS OUTLET FUNCTIONS

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Xiamen (CN); Jianmin Chen, Xiamen (CN); Bin Chen, Xiamen (CN); Huasong Zhou, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 14/272,903

(22) Filed: May 8, 2014

(65) Prior Publication Data

US 2014/0332607 A1 Nov. 13, 2014

(30) Foreign Application Priority Data

May 8, 2013 (CN) ..... 2013 1 0167222
May 8, 2013 (CN) ..... 2013 2 0246023 U

(51) Int. Cl.

| | |
|---|---|
| ***B05B 7/14*** | (2006.01) |
| ***B05B 7/32*** | (2006.01) |
| ***B05B 1/16*** | (2006.01) |
| ***B05B 1/18*** | (2006.01) |
| *E03C 1/04* | (2006.01) |
| *B05B 15/06* | (2006.01) |

(52) U.S. Cl.

CPC ..... *B05B 1/1627* (2013.01); *B05B 1/1654* (2013.01); *B05B 1/18* (2013.01); *B05B 1/185* (2013.01); *B05B 15/067* (2013.01); *E03C 1/0408* (2013.01); *E03C 2001/0414* (2013.01)

(58) Field of Classification Search

CPC ..... B05B 1/1636; B05B 1/169; B05B 1/18; B05B 12/002

USPC ..... 239/436, 437, 441, 443, 558, 562

See application file for complete search history.

(56) References Cited

U.S. PATENT DOCUMENTS

| | | | | | |
|---|---|---|---|---|---|
| 4,618,100 | A * | 10/1986 | White et al. | ..... | 239/440 |
| 5,772,121 | A * | 6/1998 | Wang | ..... | 239/394 |
| 6,896,206 | B1 * | 5/2005 | Chen | ..... | 239/437 |
| 7,380,731 | B1 * | 6/2008 | Hsu | ..... | 239/447 |
| 2003/0042331 | A1 * | 3/2003 | Lu | ..... | 239/436 |

* cited by examiner

*Primary Examiner* — Davis Hwu

(74) *Attorney, Agent, or Firm* — Rabin & Berdo, P.C.

(57) ABSTRACT

A shower with various outlet functions includes a main body part and outlet part, the main body part has an inlet waterway, and at least one first inlet hole and one second inlet hole communicated with the inlet waterway; the outlet part, is connected to the main body part in a moving manner, and is provided with at least one first water division hole group and one second water division hole group, and the first water division group includes at least two first division holes, and the first inlet holes are coupling with the first water division hole, the second water division group includes at least two second division holes, and the second water division holes are coupling with the second inlet hole, and the first and second water division hole communicates with the first and second inlet hole respectively in a switching manner.

8 Claims, 12 Drawing Sheets

SHOWER WITH VARIOUS OUTLET FUNCTIONS

FIELD OF THE INVENTION

The present invention relates to a shower with various outlet functions.

BACKGROUND OF THE INVENTION

The shower at the prior art comprises a main body part and an outlet part, and an inlet waterway communicated with water source and an inlet hole communicated with the inlet waterway are arranged on the main body part; the outlet part is connected to the main body part in a moving manner and is provide with a water division hole group comprising a plurality of water division holes, and the inlet hole is coupling with the water division hole, and the switching communication between the water division hole and the inlet hole is achieved through the relative movement of the outlet part to the main body part. And the shower at the prior art is provided with only one water division hole group to switch with dull outlet function and small functions amount.

SUMMARY OF THE INVENTION

The object of the present invention is to offer a shower with various outlet functions which overcomes the defects of the shower at the prior art.

One of the technical proposal solving the technical matter in the present invention is:

The shower with various outlet functions, comprises

Main body part, is provided with an inlet waterway communicated with water source, and at least one first inlet hole and one second inlet hole communicated with the inlet waterway;

Outlet part, is connected to the main body part in a moving manner, and is provided with at least one first water division hole group and one second water division hole group, and the first water division group comprises at least two first division holes, and the first inlet holes are coupling with the first water division hole, the second water division group comprises at least two second division holes, and through the relative movement of the outlet part to the main body part, the second water division holes are coupling with the second inlet hole, and the first water division hole is communicated with the first inlet hole in a switching manner and the second water division hole is communicated with the second inlet hole in a switching manner.

In a preferred embodiment, the outlet part is provided with a plurality of outlet cavities corresponding to various outlet functions, and each outlet cavity is communicated with at least one of at least two first water division hole and at least two second water division holes respectively.

In a preferred embodiment, the outlet part is connected to the main body part in a rotating manner, and the first inlet hole and the second inlet hole are alternatively arranged along with the radical direction of the rotation axis of the outlet part, and the first water division hole group and the second water division hole group are alternatively arranged along with the radical direction of the rotation axis of the outlet part, and the first water division holes are alternatively arranged along circular direction, and the second water division holes are alternatively arranged along circular direction.

In a preferred embodiment, the central angles of the at least one first water division hole and radical direction corresponding at least one second water division hole are different.

In a preferred embodiment, at least one first water division hole and at least one second water division hole are alternatively arranged along circular direction.

In a preferred embodiment, the first water division hole group and the second water division hole group are arranged in internal and external partition along with the radial direction of the rotation axis of the outlet part, and at least one second outlet hole of the second outlet hole group is closed.

Another technical proposal solving the technical matter in the present invention is:

The shower with various outlet functions, comprises

Main body part, is provided with an inlet waterway communicated with water source;

Outlet part, is mounted to the main body part in a fixing manner, and is provided with at least one first water division hole group and one second water division hole group, and the first water division hole group comprises at least two first water division hole, and the second water division hole group comprises at least two second water division hole;

And a switching disc, is mounted between the main body part and the outlet part in a moving manner, and is provided with at least one first inlet hole and one second inlet hole which are communicated with the inlet waterway, and the first inlet hole is coupling with the first water division hole, and the second inlet hole is coupling with the second inlet hole, through the relative movement of the switch disc to the main body part and the outlet part, the first water division hole is communicated with the first inlet hole in a switching manner and the second water division hole is communicated with the second inlet hole in a switching manner.

Compared with the technical proposal at the prior, the benefits of the present invention are:

1 at least one first inlet hole and one second inlet hole are arranged on the main body part, and at least one first water division hole group and one second water division hole group are arranged on the outlet part, and the first water division hole is communicated with the first inlet hole in a switching manner and the second water division hole is communicated with the second inlet hole in a switching manner through the relative movement of the outlet part to the main body part, and the switch between at least two water division hole groups can be achieved with various outlet pattern;

2 the outlet part is connected to the main body part in a rotating manner, the first inlet hole and the second inlet hole are alternatively arranged along with the radical direction of the rotation axis of the outlet part, and the first water division hole group and the second water division hole group are alternatively arranged along with the radical direction of the rotation axis of the outlet part, and the first water division holes are alternatively arranged along circular direction, and the second water division holes are alternatively arranged along circular direction, so that the arrangement is reasonable, the structure is compact with low space occupation;

3 a fixed cover is fixed to the supporting cover, and a circular wall is arranged on the fixed cover, and the circular wall is fixed to the internal surrounding wall in a sealing manner, and the fixed cover is provided with a extended part that extends out of the internal surrounding wall, and then the water pressure receiving area is reduced, to be the sectional are of the circular wall.

DESCRIPTION OF THE PREFERRED EMBODIMENTS

With the following description of the drawings and specific embodiments, the invention shall be further described in details.

Figure 1:
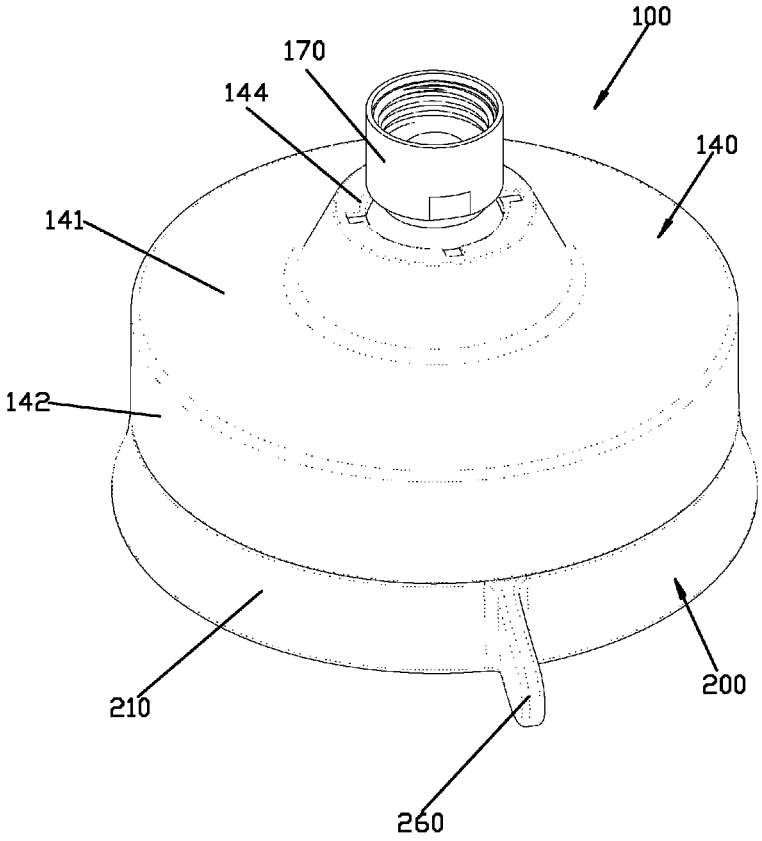
FIG. 1 shows the solid abridged general view of the shower in the present embodiment.
Figure 2:
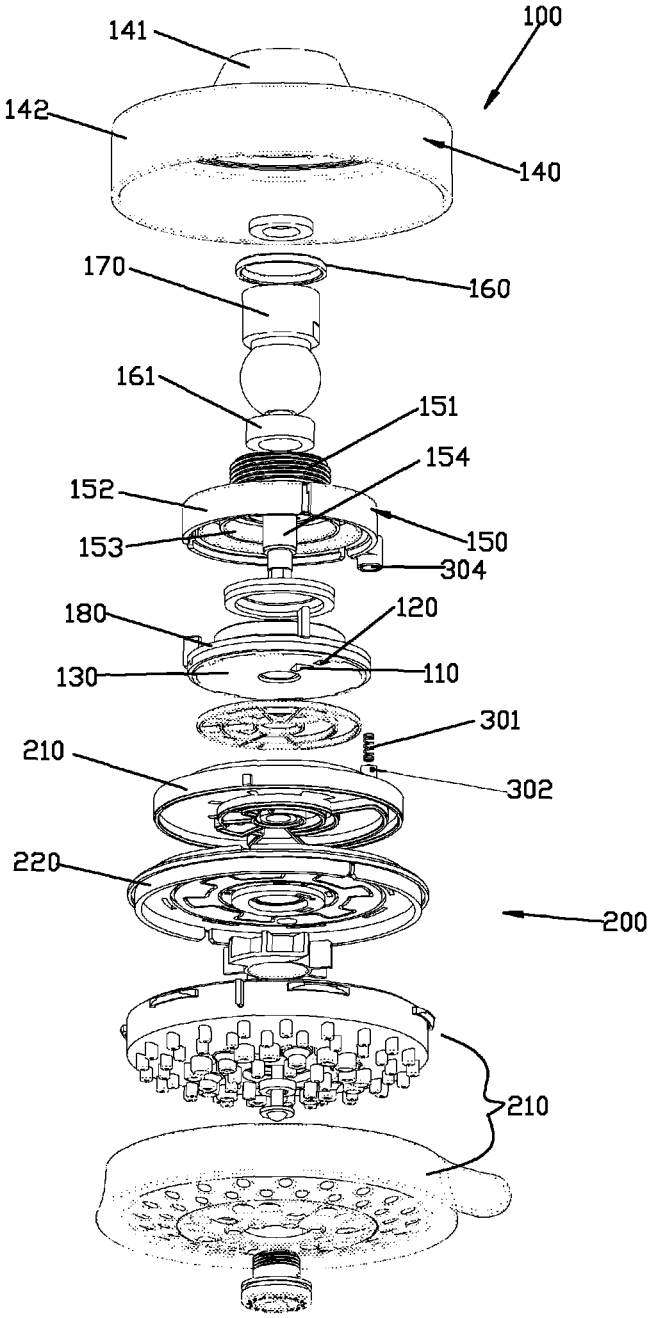
FIG. 2 shows the solid exploded view of the shower in the present embodiment.
Figure 3:
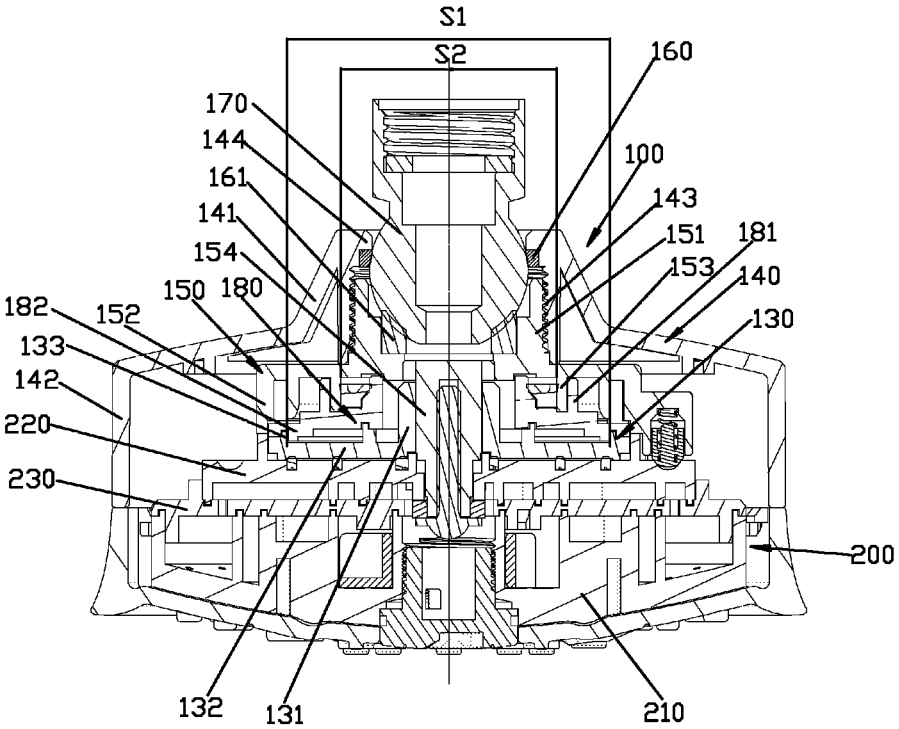
FIG. 3 shows the first sectional view of the shower in the present embodiment.
Figure 4:
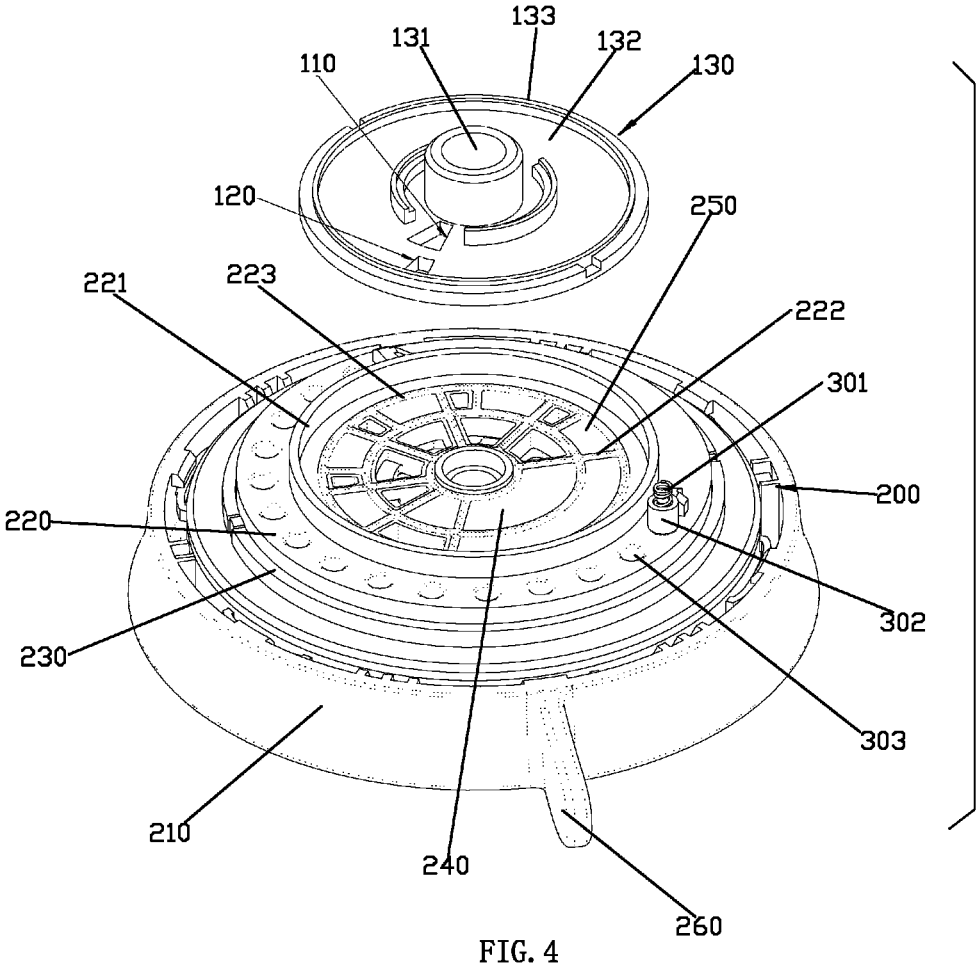
FIG. 4 shows the structure view of the outlet part and the supporting cover of the shower in the present embodiment.
Figure 5:
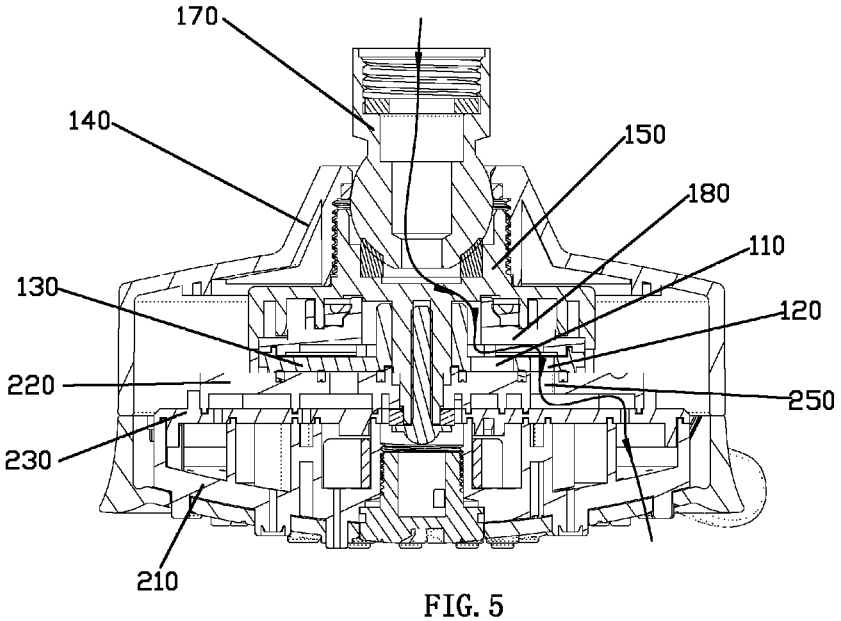
FIG. 5 shows another sectional view of the shower in the embodiment 1, and water comes out of the pattern 1 in shower manner.

According to FIG. 1, 2, 3, 4 and 5, the shower with various outlet functions comprises main body part 100 and outlet part 200.

The main body part 100 is provided with an inlet waterway communicated with water source, a first inlet hole 110 and a second inlet hole 120 which are communicated with the inlet waterway. In the present embodiment, the main body part 100 comprises a fixed part, a supporting cover 130 and a fixed cover 180.

The fixed part comprises a body 140, a fixed seat 150, a bush 160, a spherical connector 170 and a base 161.

The body 140 comprises a upper shell 141, a outer ring shell 142 that is extended downward from the periphery of the upper shell 141, a internal thread sleeve 143 that is extended downward from the periphery of the opening of the upper shell 140 and located in the outer ring shell 142 and a flange 144 that is extended inward from the upper periphery of the opening of the upper shell 141. The fixed seat 150 comprises an external thread sleeve 151, a connecting wall that is extended outward from the periphery of the external thread sleeve 151, an external surrounding wall 152 that is extended downward from the periphery of the connecting wall, a internal surrounding wall 153 that is fixed under the connecting wall and located in the external surrounding wall 152 concentrically, a fixed shaft 154 that is fixed in the external thread sleeve 151, and the fixed shaft 154 is fixed to the external thread sleeve 151 through several spokes. The internal thread sleeve 143 is passed through by the spherical connector 170 from bottom to top, and the bush 160 is arranged to the spherical connector 170 in a sleeving manner, and the base is arranged to be a revolution structure with a spherical gap on its top to support the spherical part of the spherical connector 170, and the external thread sleeve 151 is screwed with the internal thread sleeve 143 and against the base 161, so that the connection is made, and water can flow through the spherical connector 170, the gap between the fixed shaft 154 and the external thread sleeve 151, the gap between the internal surrounding wall and the fixed shaft 154, the outlet cavity and the inlet hole.

The supporting cover 130 is provided with rotation sleeve 131, and a cover plate 132 is extended outward from the lower periphery of the rotation sleeve 131, and an external ring 133 is arranged at the end of the periphery of the cover plate 132. The fixed shaft is surrounded by the fixed cover 180, and a gap is between the fixed shaft and the fixed cover 180; a upper internal circular wall 181 and a lower external circular wall 182 are arranged on the fixed cover 180, and the upper internal circular 181 is fixed to the internal surrounding wall 153 in a sealing manner, and the rotation sleeve 131 is sleeved out of the fixed shaft 154 in a rotating and sealing manner, and the lower external circular wall is fixed to the external ring 133 in a sealing manner, so that an inlet cavity which is part of the inlet waterway is formed between the fixed cover and the supporting cover 130. The fixed cover 180 is provided with a extended part that is extended out of the internal surrounding wall 153, so that the water pressure receiving area of the assembly formed by the supporting cover and the fixed cover is S2 but S1 that is the area of supporting cover, and the water pressure tolerance is reduced. The first inlet hole 110 and the second inlet hole 120 are arranged on the cover plate 132 of the supporting cover in a penetrating manner, and are alternatively arranged along with the radial direction of the axis of the fixed shaft 154.

The outlet part 200 comprises face cover assembly 210 and the water division assembly that is fixed to the face cover assembly 210, and the face cover assembly is provided a plurality of outlet cavities with different spray manners, and in the present embodiment, the spray manners comprises shower manner, fast massage manner, concentrating manner, slow massage manner, splash manner and single pole manner. According to the demand of users, a handle 260 can also be arranged at the face cover assembly 210. The water division assembly comprises a first water division body 220 and a second water division body 230, and the first water division hole group and the second water division hole group are arranged on the first water division body 220 and are arranged in internal and external partition along with the radial direction of the rotation axis of the outlet part 200. The first water division hole group comprises seven first division holes 240, and the second water division hole group comprise eleven second division holes 250, and the first water division holes 240 are alternatively arranged along the circular direction, and the second water division holes 250 are alternatively arranged along the circular direction. In the present embodiment, a sealing surrounding wall 221 is arranged on the first division body 220 in a convex manner, and a radial direction segment 222 and a center segment 223 is arranged in the sealing surrounding wall 221, through which the surrounding wall is divided to a plurality of water division cavities, and the opening of the water division cavities is the water division hole. The second water division body 230 is mounted under the first water division body, and a plurality of middle cavities communicating with a plurality of outlet cavities are formed in a coupling manner, so that each middle cavity is communicated with at least two water division holes and one of at least two water division holes according to user's demand. In one embodiment, the central angles of the at least one first water division hole 240 and radical direction corresponding at least one second water division hole 250 are different, for example, the central angle of one first water division hole 240 is equal to the sum of the central angles of two radical direction corresponding second water division holes; and at least one second outlet hole in the second outlet hole group is closed.

The outlet part 200 is connected to fixed shaft 154 of the main body part 100 in a rotating manner, and the periphery of the face cover assembly 210 is connected to the outer ring shell 142 in a coupling manner. In the present embodiment, the first water division body 220 and the second water division body 230 are connected to the fixed shaft in a rotating manner. the first inlet hole 110 is coupling with the first water division hole 240, and the second inlet hole 120 is coupling with the second water division hole 250. The first water division hole is communicated with the first inlet hole in a switching manner and the second water division hole is communicated with the second inlet hole through the relative rotation of the outlet part to the main body part.

According to user's demand, a locating mechanism is arranged between the first water division body and the supporting cover, which comprises a groove which is arranged on the boss 304 extended from the fixed seat in a concaving manner, a spring 301 mounted in the groove, a locating pin which is against the spring and connected to the spring in a sliding manner and a plurality of locating groove mounted to the outlet part (such as the locating groove 303 of the first water division body), and the locating pin is connected to one of the locating groove in a coupling manner.

Figure 6:
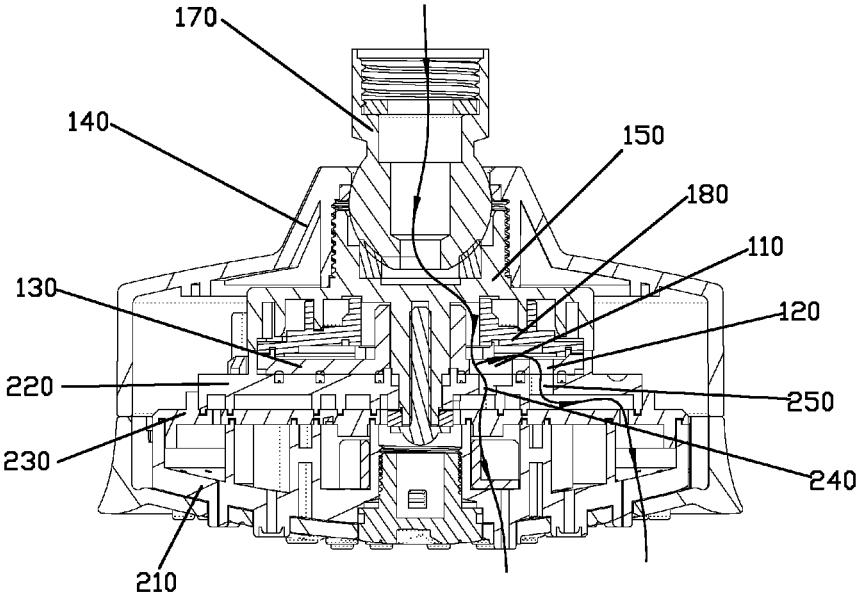
FIG. 6 shows another sectional view of the shower in the embodiment 1, and water comes out of the pattern 2 in shower manner and fast massage manner.
Figure 7:
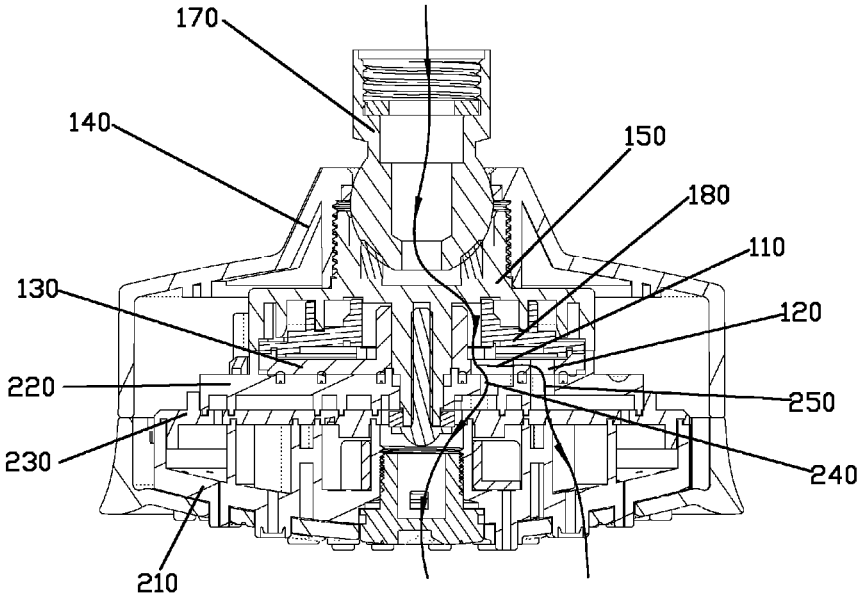
FIG. 7 shows another sectional view of the shower in the embodiment 1, and water comes out of the pattern 3 in concentrating manner and shower manner.
Figure 8:
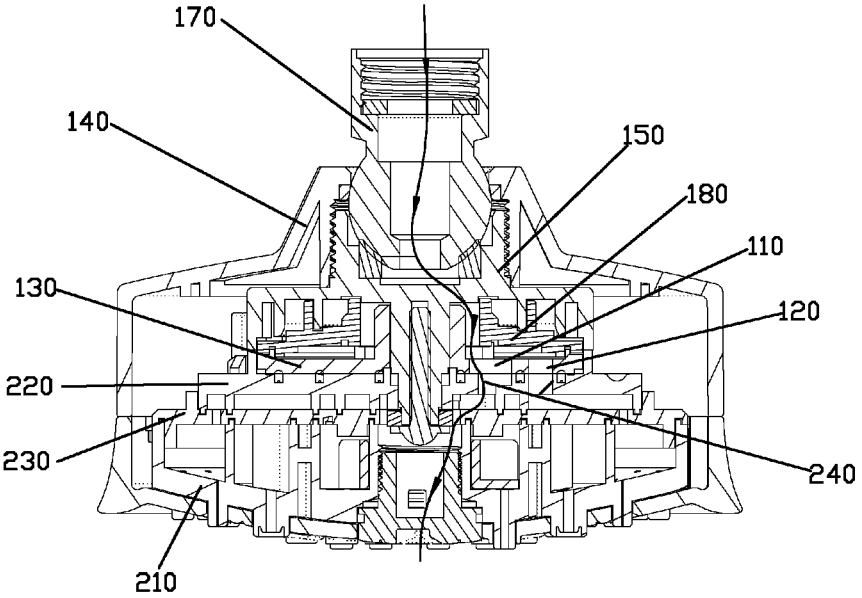
FIG. 8 shows another sectional view of the shower in the embodiment 3, and water comes out of the pattern 4 in concentrating manner.
Figure 9:
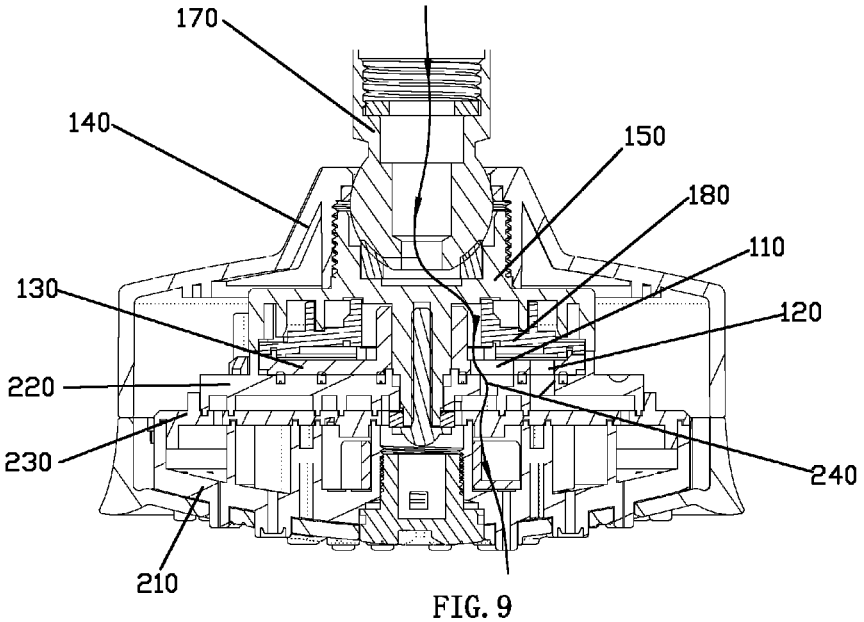
FIG. 9 shows another sectional view of the shower in the embodiment 1, and water comes out of the pattern 5 in slow massage manner.
Figure 10:
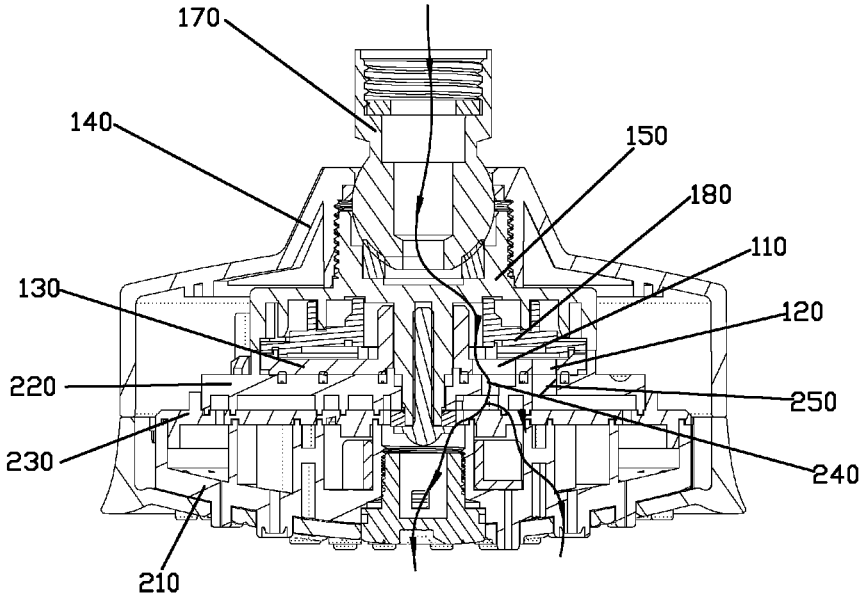
FIG. 10 shows another sectional view of the shower in the embodiment 1, and water comes out of the pattern 6 in slow massage manner and splash manner.
Figure 11:
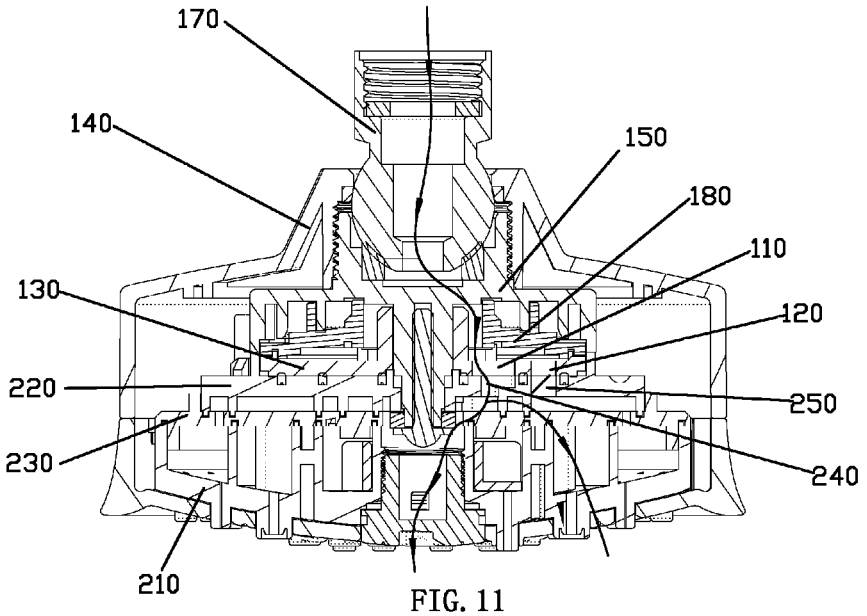
FIG. 11 shows another sectional view of the shower in the embodiment 1, and water comes out of the pattern 7 in splash manner and single pole manner.
Figure 12:
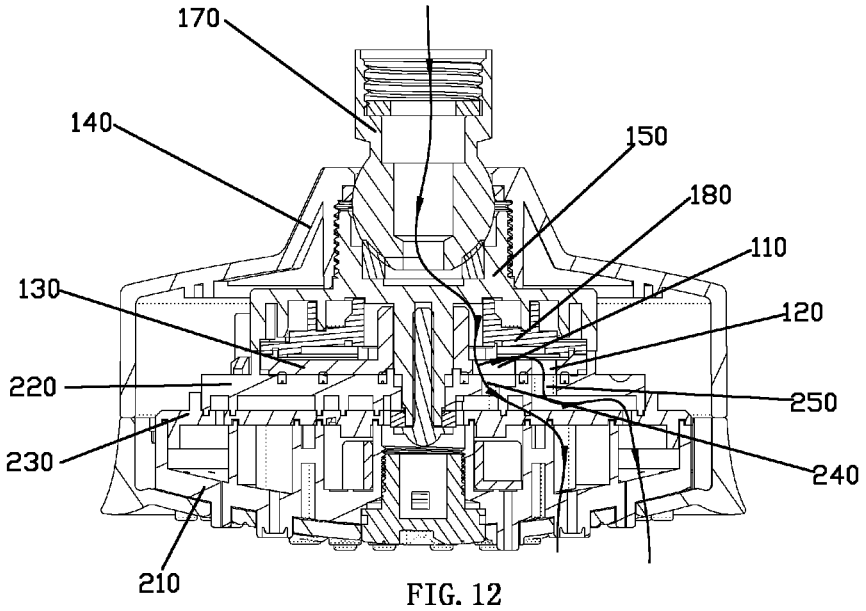
FIG. 12 shows another sectional view of the shower in the embodiment 1, and water comes out of the pattern 8 in single pole manner and shower manner.
Figure 13:
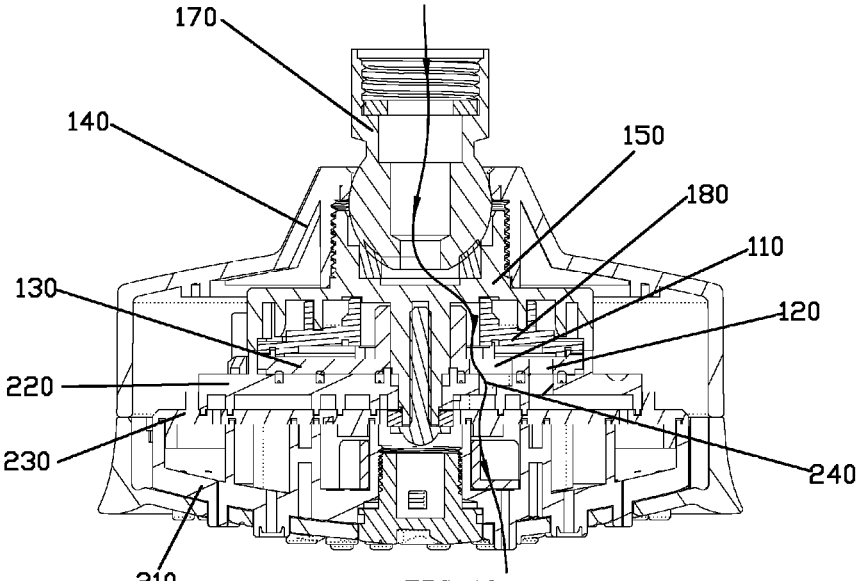
FIG. 13 shows another sectional view of the shower in the embodiment 1, and water comes out of the pattern 9 in fast massage manner.
Figure 14:
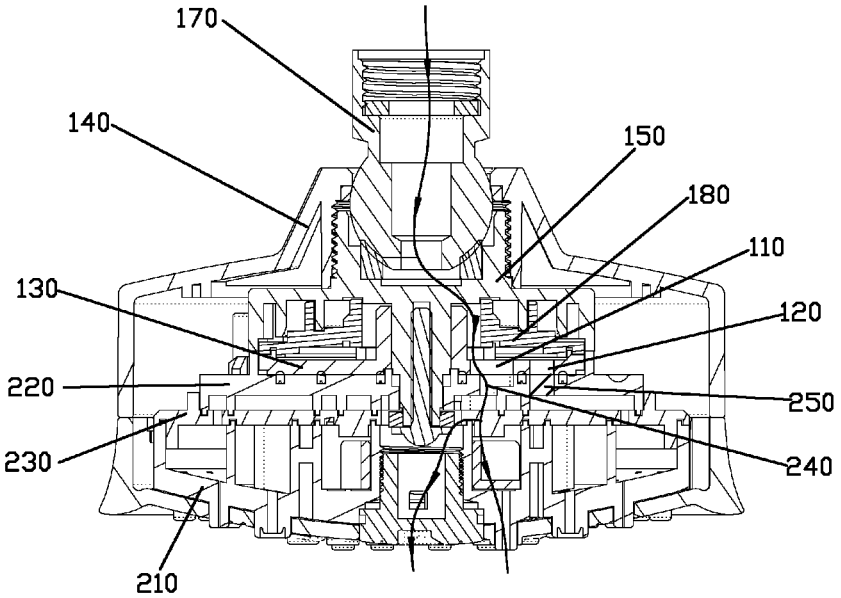
FIG. 14 shows another sectional view of the shower in the embodiment 1, and water comes out of the pattern 10 in fast massage manner and concentrating manner.
Figure 15:
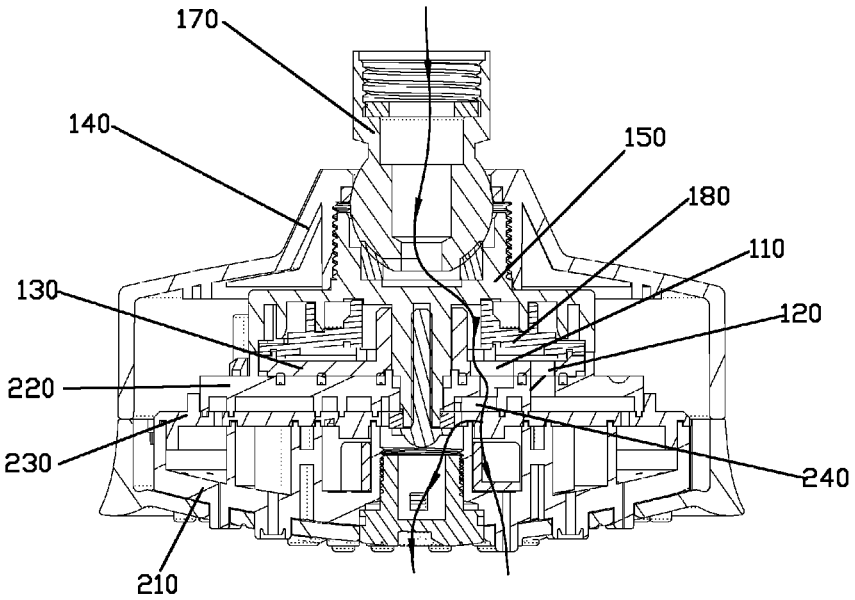
FIG. 15 shows another sectional view of the shower in the embodiment 1,and water comes out of the pattern 11 in slow massage manner and concentrating manner.
Figure 16:
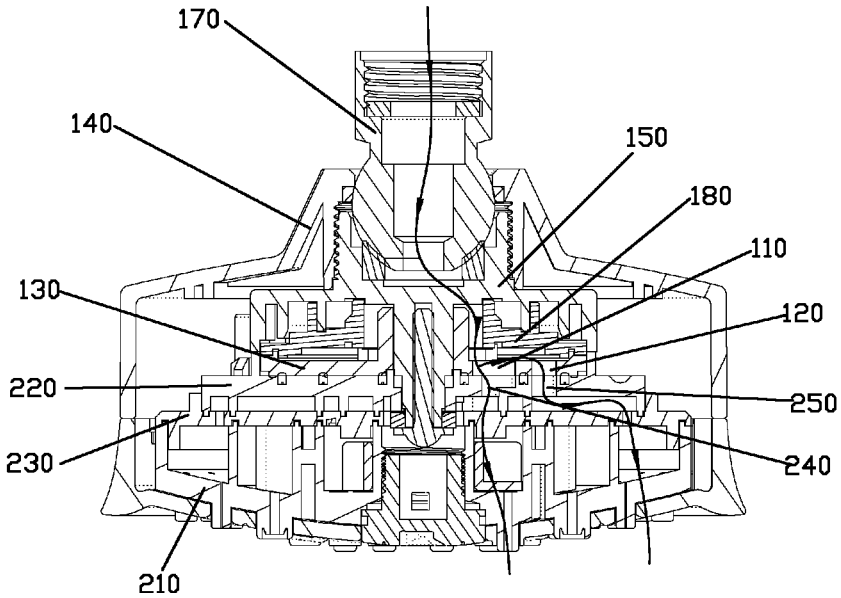
FIG. 16 shows another sectional view of the shower in the embodiment 1, and water comes out of the pattern 12 in slow massage manner and shower manner.
Figure 17:
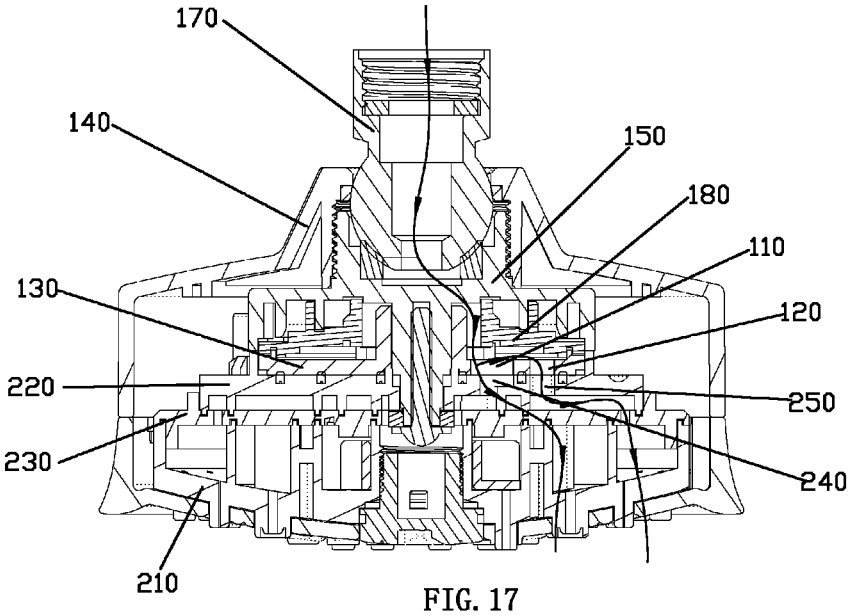
FIG. 17 shows another sectional view of the shower in the embodiment 1, and water comes out of the pattern 13 in splash manner and shower manner.
Figure 18:
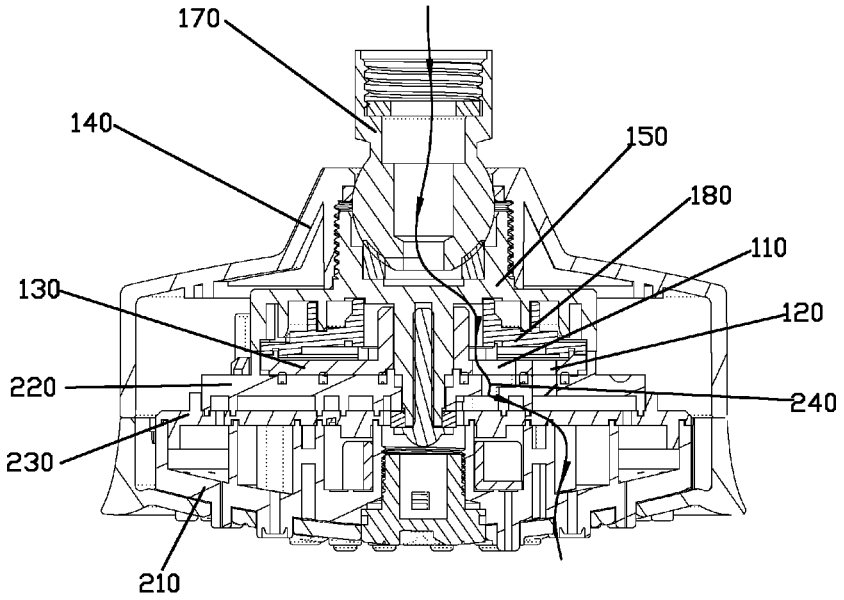
FIG. 18 shows another sectional view of the shower in the embodiment 1, and water comes out of the pattern 14 in splash manner.
Figure 19:
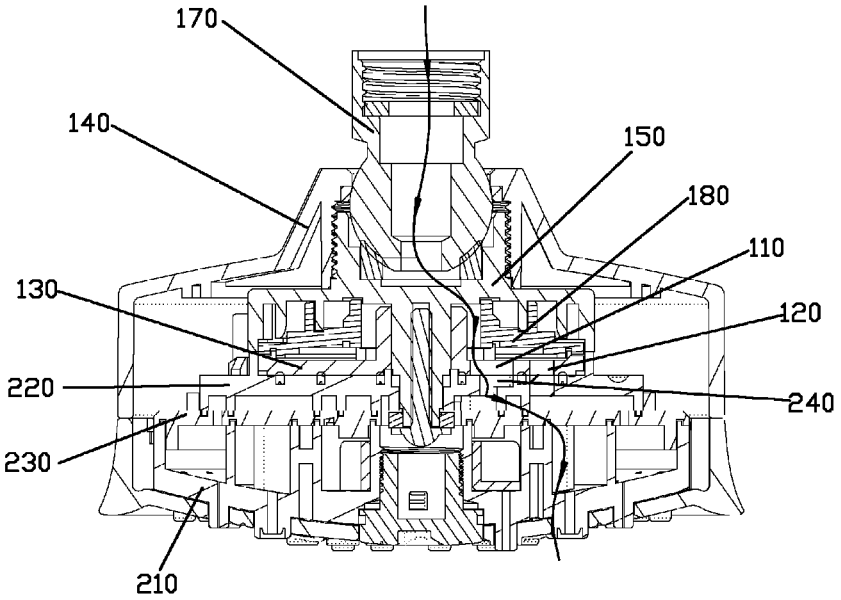
FIG. 19 shows another sectional view of the shower in the embodiment 1, and water comes out of the pattern 15 in single pole manner.

According to FIGS. 5 to 19, 15 different outlet manners in the present embodiment are showed, such as rotating to one of the manners, the second water division hole is sealed, and one kind of spray is out.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

What is claimed is:

1. A shower with various outlet functions, comprising:

a main body part, provided with an inlet waterway communicating with a water source, and at least one first inlet hole and one second inlet hole communicating with the inlet waterway;

an outlet part, connected to the main body part in a moving manner, provided with at least one first water division hole group and one second water division hole group, the first water division group comprising at least two first division holes, the first inlet holes coupled to with the first water division hole, the second water division group comprising at least two second division holes, the second water division holes coupled to the second inlet hole, wherein through relative movement of the outlet part to the main body part, the first water division hole communicates with the first inlet hole in a switching manner and the second water division hole communicates with the second inlet hole in a switching manner, the outlet part is connected to the main body part in a rotating manner, the first inlet hole and the second inlet hole are alternatively arranged along a radial direction of the rotation axis of the outlet part, the first water division holes group and the second water division hole group are alternatively arranged along the radial direction of the rotation axis of the outlet part, the first water division holes are alternatively arranged along a circular direction, and the second water division holes are alternatively arranged along the circular direction.

2. The shower with various outlet functions according to claim 1, wherein, the outlet part is provided with a plurality of outlet cavities corresponding to various outlet functions, and each outlet cavity communicates with at least one of at least two first water division hole and at least two second water division holes respectively.

3. The shower with various outlet functions according to claim 1, wherein, a central angle of the at least one first water division hole and the radial direction corresponding to the at least one second water division hole are different.

4. The shower with various outlet functions according to claim 1, wherein, the at least one first water division hole and the at least one second water division hole are alternatively arranged along a circular direction.

5. The shower with various outlet functions according to claim 1, wherein, the first water division hole group and the second water division hole group are arranged in internal and external partition along with the radial direction of the rotation axis of the outlet part, and at least one second outlet hole of the second outlet hole group is closed.

6. The shower with various outlet functions according to claim 1, wherein, the main body part comprises a fixed part and a supporting cover, the supporting cover is mounted in the fixed part, and the first inlet hole and the second inlet hole are arranged on the supporting cover in a penetrating manner;

the outlet part comprises a face cover assembly and a water division body fixed to the face cover assembly, the face cover assembly is provided with outlet cavity, and the first water division hole group and the second water division hole group are arranged on the water division body.

7. The shower with various outlet functions according to claim 6, wherein, the fixed part comprises a body and a fixed seat, the fixed seat is mounted in the body in a fixing manner and is provided with an internal surrounding wall;

a fixed cover is fixed to the supporting cover, and an inlet cavity is formed between the fixed cover and the supporting cover and is part of the inlet waterway;

the fixed cover is provided with a circular wall that is fixed to the internal surrounding wall in a sealing manner, and is provided with an extended part that is extended out of the internal surrounding wall.

8. A shower with various outlet functions, comprising:

a main body part, provided with an inlet waterway communicating with a water source;

an outlet part, mounted to the main body part in a fixing manner, provided with at least one first water division hole group and one second water division hole group, and the first water division hole group comprising at least two first water division hole, and the second water division hole group comprising at least two second water division hole;

a switching disc, mounted between the main body part and the outlet part in a moving manner, is provided with at least one first inlet hole and one second inlet hole which communicate with the inlet waterway, the first inlet hole is coupling with the first water division hole, and the second inlet hole is coupling with the second inlet hole, wherein through relative movement of the switch disc to the main body part and the outlet part, the first water division hole communicates with the first inlet hole in a switching manner and the second water division hole communicates with the second inlet hole in a switching manner, the outlet part is connected to the main body part in a rotating manner, the first inlet hole and the second inlet hole are alternatively arranged along the radial direction of the rotation axis of the outlet part, the first water division hole group and the second water division hole group are alternatively arranged along the radial direction of the rotation axis of the outlet part, the first water division holes are alternatively arranged along a circular direction, and the second water division holes are alternatively arranged along the circular direction.

* * * * *